United States Patent [19]

Huang

[11] Patent Number: 4,853,161

[45] Date of Patent: Aug. 1, 1989

[54] AUTO TURNING-OFF HUMIDIFIER

[75] Inventor: Koa-Cherng Huang, Tainan, Taiwan

[73] Assignee: Han Chi Hang Co., Ltd., Taiwan

[21] Appl. No.: 219,879

[22] Filed: Jul. 11, 1988

Related U.S. Application Data

[63] Continuation of Ser. No. 113,205, Oct. 27, 1987, abandoned.

[51] Int. Cl.[4] ..... B01F 3/04

[52] U.S. Cl. ..... 261/81; 261/DIG. 48; 239/102.2

[58] Field of Search ..... 261/DIG. 48, 81; 239/102.2

[56] References Cited

U.S. PATENT DOCUMENTS

| | | | |
|---|---|---|---|
| 4,087,495 | 5/1978 | Umehara | 261/DIG. 48 |
| 4,410,139 | 10/1983 | Nishikawa et al. | 261/DIG. 48 |
| 4,663,091 | 5/1987 | Seo | 261/DIG. 48 |

FOREIGN PATENT DOCUMENTS

| | | | |
|---|---|---|---|
| 53-27253 | 3/1978 | Japan | 261/DIG. 48 |
| 54-101507 | 8/1979 | Japan | 239/102.2 |
| 56-59142 | 5/1981 | Japan | 261/DIG. 48 |

*Primary Examiner*—Tim Miles

*Attorney, Agent, or Firm*—Larson and Taylor

[57] ABSTRACT

An auto turning-off humidifier having a water sensor with a sensing needle that can automatically function to cut off electricity if the water in the hollowed space of the base becomes less and cannot be touched by the sensing needle.

1 Claim, 5 Drawing Sheets

AUTO TURNING-OFF HUMIDIFIER

This application is a continuation of application Ser. No. 113,205, filed Oct. 27, 1987, now abandoned.

BACKGROUND OF THE INVENTION

In cold climate warming equipments are indispensable to keep houses or rooms warm enough for living when winter comes, and humidifying equipments are also needed at the same time for modifying the humidity therein, or otherwise human skin will crack because of excessive dryness in the air.

Generally, a humidifier as shown in FIG. 1 is used for a humidifying equipment around the clock, and it commonly includes a water tank on its base and a vapor room beside the water tank, but a conventional humidifier often has shortcomings as listed below.

1. Small water capacity. So it needs frequent water supplying.

2. Danger can be caused by lacking a safety switch in case the whole humidifier should be tilted by accident or the water should become too little.

3. Dripping sounds. Some of water vapors coming out will touch the lid, condensing to water drops which fall down the wall to the bottom plate giving out dripping sounds to disturb the silence, especially during the dead night.

4. A bad outward look or inconvenience. Some humidifiers have a handle set on it to make it convenient for carrying, but it can impair their outward look. On the contrary, some do not have a handle so as not to impair their outward look, but then they are not convenient for carrying.

SUMMARY OF THE INVENTION

In view of the drawbacks mentioned-above, the inventor has worked out this invention in order to improve conventional humidifiers.

A water sensor is set in this humidifier at one side of the base protruding into the water in the base, and can function to cut off the electric power when the water therein becomes less and less, impossible to be touched by the sensor needle. The water tank is placed on the base; a vapor room is set in the central part of the water tank instead of setting at its side. A sieve is set at the bottom of the vapor room to prevent water drops from dripping down, and a handle is to be set across above the sieve hidden inside this device unseen from the outside. Both the handle and the sieve have a round hole facing toward the vibrating plate for water vapor to pass through from the vibrating plate.

DETAILED DESCRIPTION OF THE INVENTION

Figure 1:
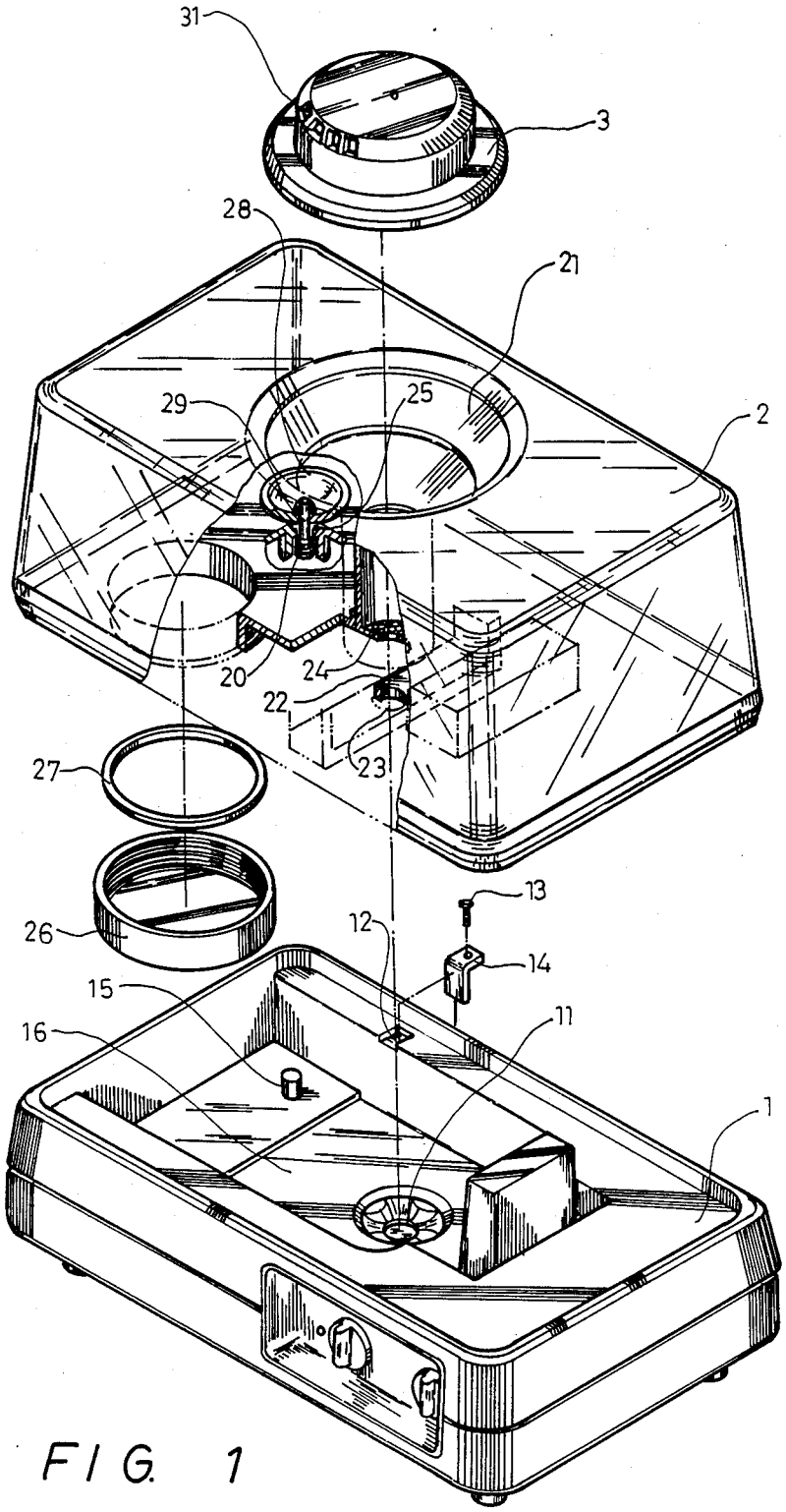
FIG. 1 is an explosive perspective of the auto turning-off humidifier in this invention.

First, this auto turning-off humidifier as shown in FIG. 1 includes base 1, water tank 2 put on base 1 and lid 3 covered on vapor room 21 as its main parts.

Figure 7:
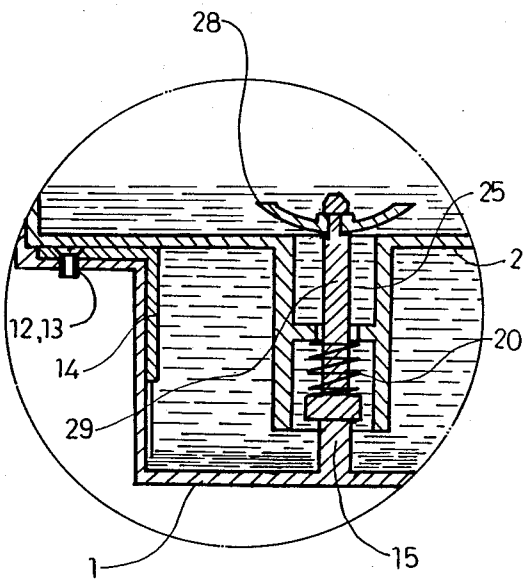
FIG. 7 is an enlarged view of a valve unit on FIG. 6.
Figure 6:
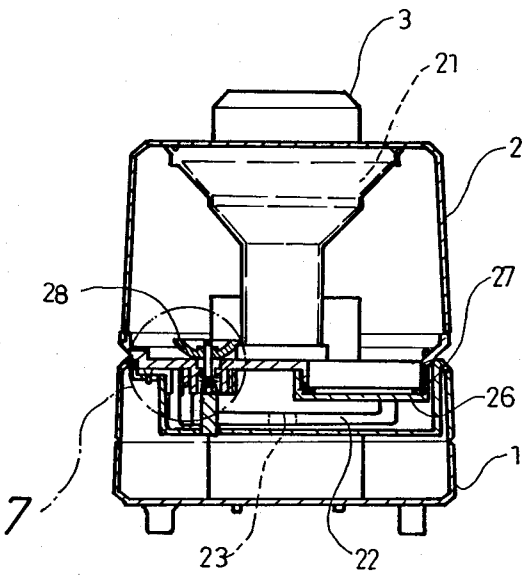
FIG. 6 is a cross-sectional side view of this humidifier in this invention.
Figure 8:
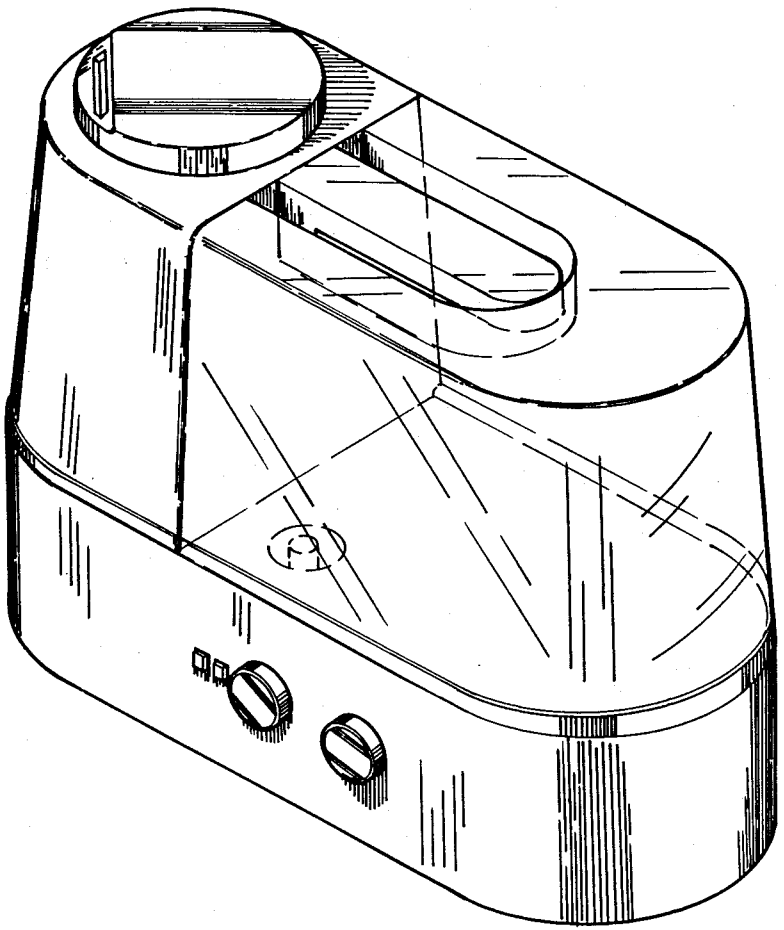
FIG. 8 is a general view of a conventional humidifier.

As shown in FIGS. 1, 6, 7, base 1 includes vibrating plate 11 which can vibrate with an extremely high frequency set at the bottom of base 1. Fixing hole 12 bored in the side wall of base 1 is for screw 13 to fix steadily water sensor 14 so that the sensing needle of water sensor 14 can extend into the water in the hollowed part of base 1 under water tank 2; water sensor 14 can function to cut off the electric power if it can not touch water in case the whole humidifier should be tilted by accident or the water therein should become less and less untouchable by the sensor needle.

Figure 2:
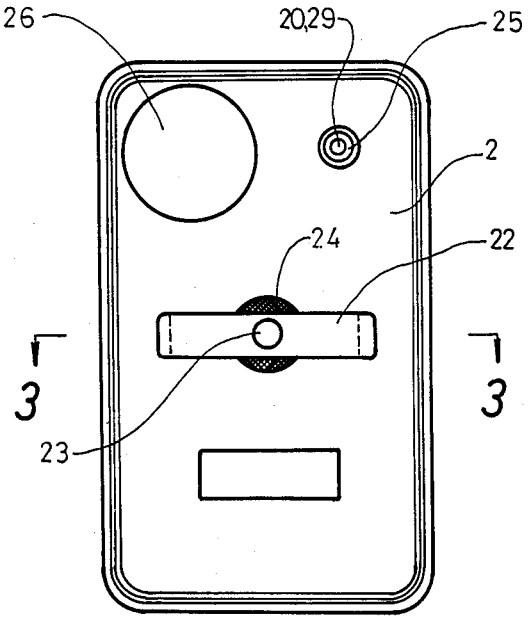
FIG. 2 is an upside view of the water tank in this invention.
Figure 3:
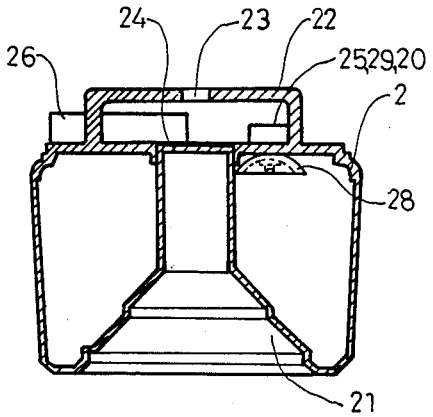
FIG. 3 is a cross-sectional view of 3—3 line on FIG. 2.

Water tank 2 shown in FIGS. 1, 2, 3 is made of a transparent material, and vapor room 21 is set in the central part of water tank 2. FIG. 2 shows the bottom of water tank 2 and FIG. 3 shows the water tank reversed up-side down. Lid 3 is used to cover vapor room 21. Handle 22 protruding down is set at the bottom of water tank 2, and has round hole 23 in its center for water vapor to go through into vapor room 21. Sieve 24 set at the bottom of vapor room 21, also has a round hole for water vapor to pass through; vapor room 21 is completely separated from water tank 2 by a pipe as its wall fixed from the top to the bottom of water tank 2 so as to prevent the water in water tank 2 from going into vapor room 21.

Rather large lid 26 set at the bottom of water tank 2 is used for both pouring water into water tank 2 and for cleaning its inside by hand or with a brush or something; lid 26 is usually sealed with anti-leak gasket 27 to prevent the water in the tank 2 from leaking out.

Water hole 25 set beside lid 26 is shut up by rubber valve 28 which is combined on post 29, and post 29 pulls down rubber valve 28 being pushed by spring 20 so rubber valve 28 can close off water hole 25. But when water tank 2 is put on base 1 as shown in FIGS. 5, 6, protrusion 15 set on the hollowed surface of base 1 just pushes up post 29 in water hole 25 of water tank 2, and post 29 is accordingly raised up pushing up rubber valve 28 to let the water in the tank 2 fall down through water hole 25 filling the hollowed space of base 1; moreover, there is a rubber gasket placed around the edge between water tank 2 and base 1 preventing the water leaking out from the edge between them.

FIG. 3 shows water tank 2 reversed upside down, and handle 22 is on the upside to make said water tank 2 convenient for carrying. When water tank 2 is put in the position as FIG. 1 shows, handle 22 is just hidden inside base 1 unseen from the outside, with round hole 23 of handle 22 just located on vibrating plate 23 in practically using this humidifier.

Figure 4:
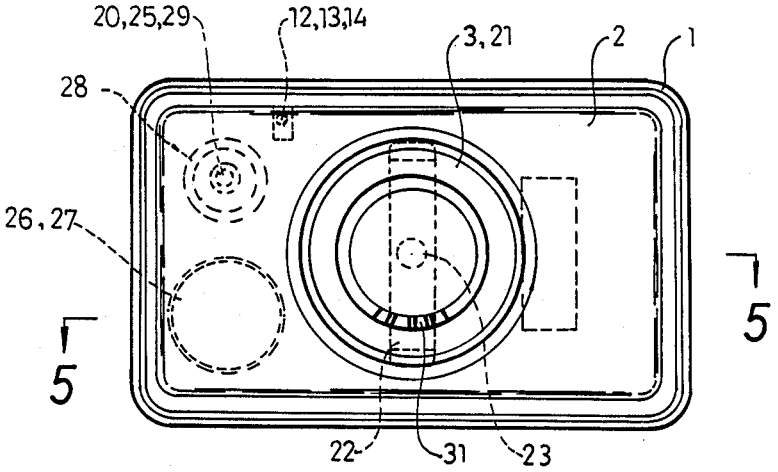
FIG. 4 is an upside view of this humidifier in this invention.
Figure 5:
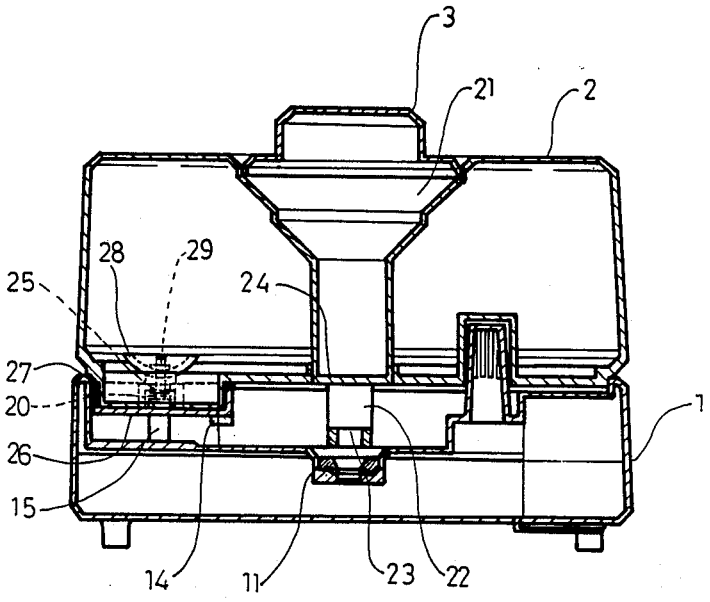
FIG. 5 is a cross-sectional view of 5—5 line on FIG. 4.

Next, as FIGS. 4, 5 show, lid 3 covering vapor room 21 has windows 31 to let out the water vapor coming through hole 23 and the round hole of sieve 24 and going into said vapor room 21.

According to the structure of this invention, the vapor room 21 is placed in the center of water tank 2, so the water volume to be stored therein can be increased a lot more than a conventional humidifier; besides, the setting of water sensor 14 can cut off electricity to prevent danger from happening in case of the water in the hollowed space of the base growing scarce or accidental inclining of the humidifier; setting the sieve at the bottom of the vapor room can eliminate the dripping sound of water drops formed with condensing water vapor in order to keep silence; the design of the hidden handle can make up the convenience for carrying this humidifier not giving any influence to its outward form.

What is claimed is:

1. An auto turning-off humidifier comprising, a base having a hollowed space for storing water, a vibrating plate set at the bottom surface of the base, and a water sensor set at a side wall of the base with its sensing needle protruding inside the hollowed space for storing water for functioning to cut off electricity in case of not touching water, a water tank being placed on said base and having a vapor room at its central part separated from the water tank to prevent the water in the tank from going into the vapor room, a vapor room being placed at the central part of the water tank, separated from the water tank, and just located just above the vibrating plate in the base, a sieve set at the bottom of the vapor room, having a round hole at its center to let the vapor produced by the vibrating plate pass through into the vapor room, and able to let down the water drops coming down from the vapor room, a lid covering a hole on the top of the vapor room and having several little windows for the vapor in the vapor room to flow out and, a handle set at the bottom of the water tank for carrying it and having a round hole for the water vapor produced by the vibrating plate to pass through.

* * * * *